US007651361B2

(12) United States Patent
Henry et al.

(10) Patent No.: US 7,651,361 B2
(45) Date of Patent: Jan. 26, 2010

(54) ELECTRICAL CONNECTOR HAVING PULL TETHER FOR LATCH RELEASE

(75) Inventors: Randall R. Henry, Harrisburg, PA (US); Michael J. Phillips, Camp Hill, PA (US); Robert D. Rix, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/113,071

(22) Filed: Apr. 30, 2008

(65) Prior Publication Data

US 2009/0275228 A1 Nov. 5, 2009

(51) Int. Cl.
*H01R 13/627* (2006.01)

(52) U.S. Cl. ..... 439/352

(58) Field of Classification Search ..... 439/352, 439/258, 344

See application file for complete search history.

(56) References Cited

U.S. PATENT DOCUMENTS

| | | | | |
|---|---|---|---|---|
| 4,984,998 | A * | 1/1991 | Duncan et al. | 439/352 |
| 5,090,916 | A * | 2/1992 | Magnier | 439/352 |
| 5,120,255 | A * | 6/1992 | Kouda et al. | 439/489 |
| 5,211,572 | A * | 5/1993 | Comstock et al. | 439/352 |
| 5,564,939 | A | 10/1996 | Maitani et al. | |
| 5,720,623 | A * | 2/1998 | Polenick et al. | 439/352 |
| 5,951,316 | A | 9/1999 | Kawano et al. | |
| 6,254,418 | B1 * | 7/2001 | Tharp et al. | 439/352 |
| 6,322,386 | B1 * | 11/2001 | Tharp et al. | 439/344 |
| 6,447,170 | B1 | 9/2002 | Takahashi et al. | |
| 6,475,009 | B2 * | 11/2002 | Below et al. | 439/271 |
| 6,506,070 | B1 * | 1/2003 | Huang | 439/352 |
| 6,572,275 | B2 * | 6/2003 | Shimoji et al. | 385/76 |
| 6,863,554 | B1 * | 3/2005 | Glad | 439/344 |
| 6,953,356 | B2 * | 10/2005 | Hisamatsu et al. | 439/258 |
| 6,994,580 | B1 * | 2/2006 | Chen | 439/344 |
| 7,008,253 | B2 | 3/2006 | Szczesny | |
| 7,029,311 | B2 * | 4/2006 | Peloza | 439/357 |
| 7,081,003 | B1 * | 7/2006 | Gregori et al. | 439/352 |
| 7,163,412 | B2 * | 1/2007 | Fan et al. | 439/258 |
| 7,247,044 | B2 * | 7/2007 | Rossi | 439/352 |
| 7,329,137 | B2 * | 2/2008 | Martin et al. | 439/344 |
| 2005/0054230 | A1 * | 3/2005 | Huang | 439/344 |
| 2005/0075001 | A1 * | 4/2005 | Shearman et al. | 439/352 |
| 2006/0030192 | A1 * | 2/2006 | Boeck et al. | 439/344 |
| 2006/0089039 | A1 * | 4/2006 | Caveney et al. | 439/352 |
| 2006/0199414 | A1 * | 9/2006 | Larkin | 439/344 |
| 2006/0276071 | A1 * | 12/2006 | Rossi | 439/352 |
| 2007/0077806 | A1 * | 4/2007 | Martin et al. | 439/344 |
| 2007/0099472 | A1 * | 5/2007 | AbuGhazaleh et al. | 439/344 |
| 2008/0057770 | A1 * | 3/2008 | Caveney et al. | 439/352 |

* cited by examiner

*Primary Examiner*—T C Patel
*Assistant Examiner*—Vladimir Imas

(57) ABSTRACT

An electrical connector includes a housing having a plurality of contacts defining a mating interface for a mating connector. A latch extends from the housing and is configured to securely couple the housing to the mating connector. The latch is depressible to an unlatched position. A tether is mated with the latch. The tether is movable between a released position and an actuated position, wherein the tether depresses the latch to the unlatched position when the tether is moved to the actuated position.

22 Claims, 4 Drawing Sheets

ELECTRICAL CONNECTOR HAVING PULL TETHER FOR LATCH RELEASE

BACKGROUND OF THE INVENTION

The subject matter herein relates generally to electrical connectors, and more particularly, to pull tethers for releasing latches of electrical connectors.

In the electronics industry, and in particular the telecommunications industry, there is an increasing trend towards smaller electrical connectors, particularly cable mounted plugs. The industries are also trending to more densely packaged connectors and connector systems. For example, in switching networks, such as patch panels, the connectors are positioned in multiple rows in tightly spaced areas. Other examples include computers having multiple ports arranged on a panel. The ports are typically arranged in a plurality of rows that are spaced close to one another.

Because the rows are positioned in such close proximity, difficulties arise for a technician to access the latching mechanism that is used to secure the connector to the panel. The spacing between the connectors is simply too small to accommodate the technician's fingers to release the latching mechanism. Additionally, the latching mechanism is typically positioned at the mating interface of the connector with the panel. The cables and/or the connectors tend to block access to the latching mechanism, particularly when the connectors are arranged in multiple rows. Damage may be caused to the latching mechanism or the connector itself by the technician when trying to reach the latching mechanism. Special tools have been developed to reach into the tight spaces to release the latching mechanism such that the electrical connector may be removed. However, such tools are cumbersome to use.

A need remains for an electrical connector that may be unlatched in an efficient manner. A need remains for a means for a technician to easily reach a latching mechanism of the electrical connector. A need remains for an unlatching system that may be field installed and/or installed after certain manufacturing steps. A need remains for an unlatching system that reduces the number of working parts for unlatching the electrical connector.

BRIEF DESCRIPTION OF THE INVENTION

In one embodiment, an electrical connector is provided including a housing having a plurality of contacts defining a mating interface for a mating connector. A latch extends from the housing and is configured to securely couple the housing to the mating connector. The latch is depressible to an unlatched position. A tether is mated with the latch. The tether is movable between a released position and an actuated position, wherein the tether depresses the latch to the unlatched position when the tether is moved to the actuated position.

Optionally, the latch may include a distal end and a fixed end, wherein the latch includes a window proximate the distal end. The tether may be received in the window. The latch may include a latching surface configured to engage a corresponding latching surface of a mating connector, wherein the latching surface is moved relatively closer to the housing when the latch is depressed to the unlatched position. Optionally, the tether may include an embossment extending therefrom, wherein the embossment engages the latch as the tether is moved to the actuated position. The embossment may have a ramp surface extending from a base to a tip. The latch may ride along the ramp surface toward the tip as the tether moves to the actuated position. The latch may ride along the ramp surface toward the base as the tether moves to the released position. Optionally, the latch may have adequate resiliency to return to the latched position when the tether is released.

In another embodiment, an electrical connector is provided that includes a housing extending between a mating end a cable end being mated to an end of a cable. The housing has a plurality of contacts arranged at the mating end. A boot surrounds the housing and is securely coupled to the cable to provide cable strain relief. The boot has a hood portion. A latch extends from the housing proximate the mating end into the hood portion of the boot and is movable between a latched position and an unlatched position. The latch is positioned relatively closer to the housing in the unlatched position. A tether is at least partially received in, and mated with the latch within, the hood portion of the boot. The tether is movable between a released position and an actuated position, wherein the tether forces the latch to the unlatched position when the tether is moved to the actuated position.

Optionally, the tether may extend through a slot in the boot. The tether may be movable with respect to the boot. The boot may include a front generally facing the mating connector and a rear, wherein the tether is loaded into the hood portion through the front and extends from the rear of the hood portion. The boot may include a shoulder defining a surface of the hood portion, wherein the shoulder defines a travel limit for the tether when the tether is moved to the actuated position.

DETAILED DESCRIPTION OF THE INVENTION

Figure 1:
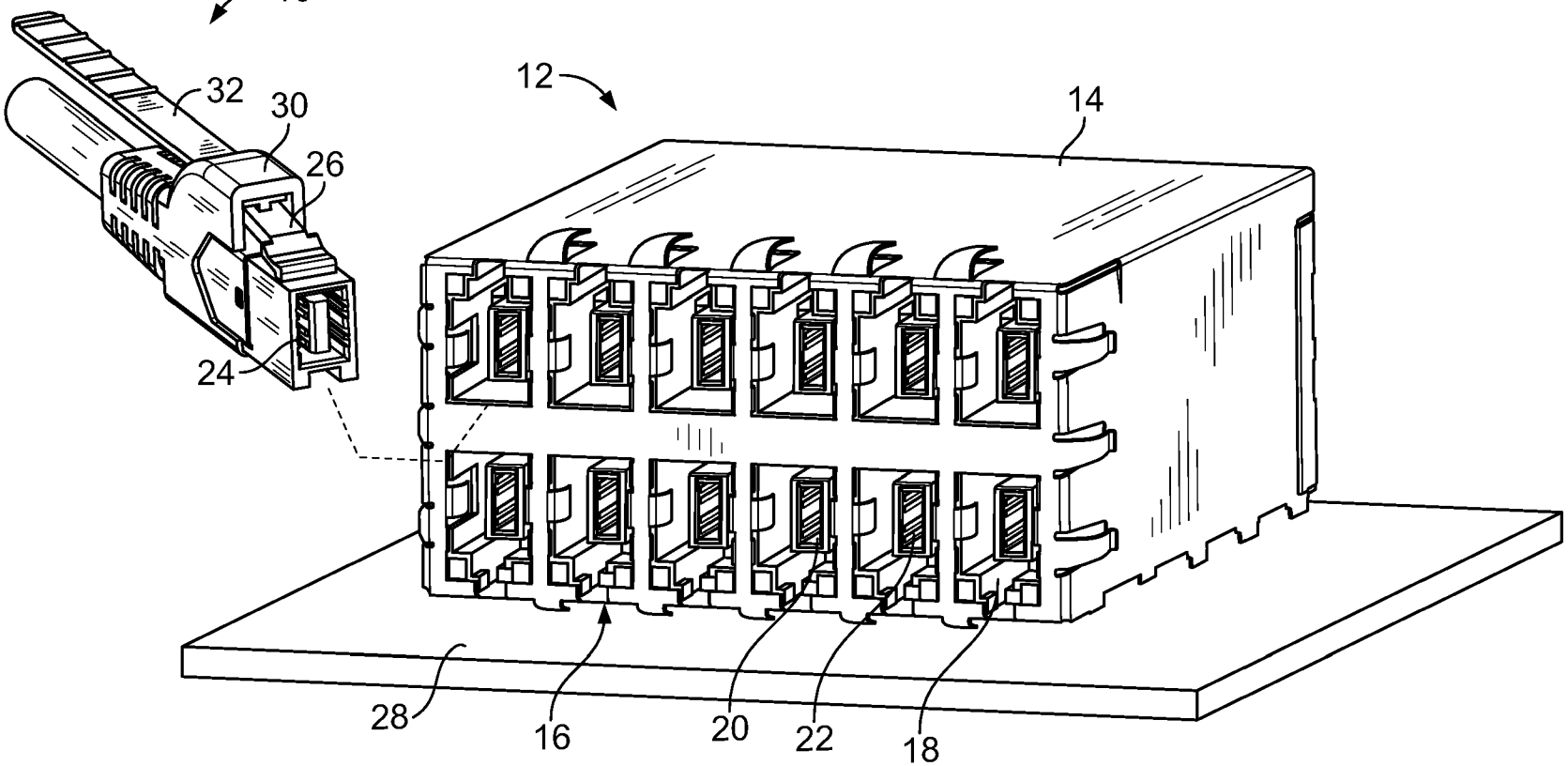
FIG. 1 is a perspective view of an exemplary electrical connector 10 formed in accordance with an exemplary embodiment.

FIG. 1 is a perspective view of an exemplary electrical connector 10 formed in accordance with an exemplary embodiment. The electrical connector 10 represents a plug connector that may be mated with a mating connector 12, represented by the receptacle connector in FIG. 1. The electrical connector 10 and the mating connector 12 are modular connectors, such as the types of electrical connectors used for connecting telecommunications equipment or computer networking equipment. In the illustrated embodiment, the electrical connector 10 and the mating connector 12 are eight pin, eight conductor (8P8C) modular connectors having signal pairs, however the subject matter described herein also has applicability to other connectors having fewer or greater numbers of pins, conductors and/or signal pairs.

In an exemplary embodiment, the mating connector 12 includes a housing 14 having multiple communication ports 16 opening to receptacles 18 that receive respective ones of the electrical connectors 10. The mating connector 12 also includes contact support members 20 that are arranged within respective ones of the receptacles 18. Each of the contact support members 20 includes a plurality of mating contacts 22 arranged along a mating interface for mating with corresponding contacts 24 of the electrical connector 10. For example, the mating contacts 22 and the contacts 24 are arranged in similar patterns for mating engagement. Optionally, the mating contacts 22 and contacts 24 are arranged, or grouped, as differential signal pairs. In an exemplary embodiment, the electrical connector 10 includes a latch 26 on an exterior surface thereof for securing the electrical connector 10 within the receptacle 18. A boot 30 is provided to surround the electrical connector 10, including the latch 26. A tether 32 is provided for actuating the latch 26.

The housing 14 is mounted to a substrate 28. Optionally, the substrate 28 may represent a circuit board and the electrical connector may be mechanically and electrically connected to the circuit board for sending and receiving signals. The substrate 28 and mating connector 12 may be mounted within an electrical device or apparatus having a communications port through which the device may communicate with other externally networked devices. Alternatively, the mating connector 12 may be wall mounted or panel mounted for connection with the electrical connectors 10. In some embodiments, the mating connector 12 may include only a single receptacle 18 and corresponding contact support member 20 for mating with a single electrical connector 10. Additionally, in some embodiments, rather than sending and receiving the signals via a circuit board, the mating connector 12, or more particularly, the contacts 22, may be terminated to an end of a cable (not shown).

Figure 2:
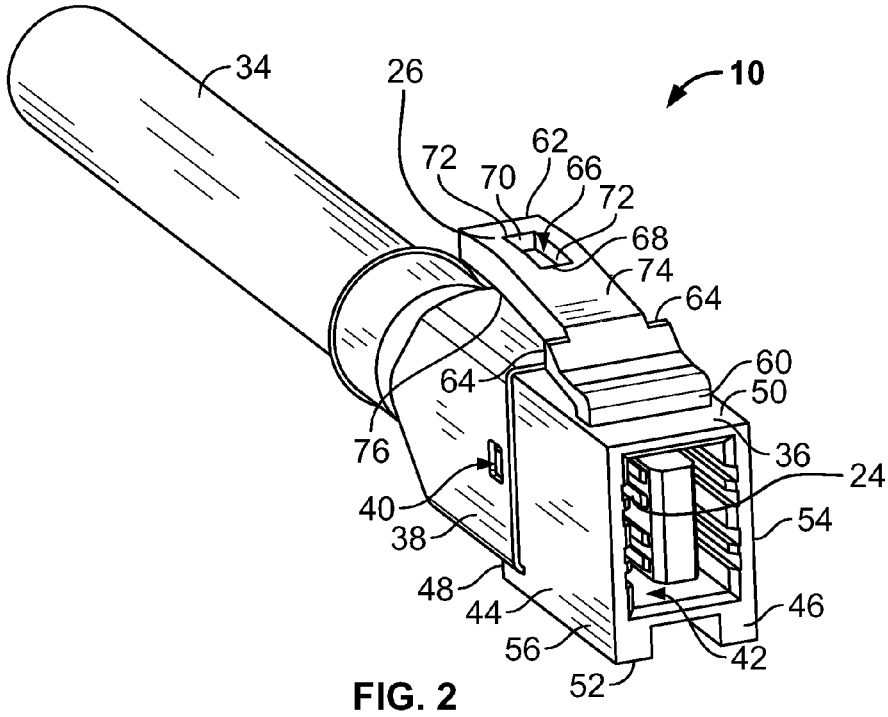
FIG. 2 is a front perspective view of the electrical connector shown in FIG. 1 with a boot and tether removed.

FIG. 2 illustrates a portion of the electrical connector 10, with the boot 30 (shown in FIG. 1) and the tether 32 (shown in FIG. 1) removed for clarity. The electrical connector 10 is coupled to an end of a cable 34. The electrical connector 10 includes a housing 36 and a ferrule 38 extending from the housing 36. The ferrule 38 is coupled to the housing 36 using a latching mechanism 40, or other type of fastener. The ferrule 38 surrounds the cable 34 and the individual wires (not shown) that form the cable 34. The ferrule 38 is securely coupled to the cable 34 to resist removal of the cable 34 from the electrical connector 10. For example, a portion of the ferrule 38 may be crimped, or otherwise secured to, the cable 34. Optionally, the ferrule 38 may be fabricated from a metal material and the ferrule 38 may provide shielding around the end of the cable 34 and the wires of the cable 34.

The housing 36 has a cavity 42 defined by outer walls 44 that define a perimeter of the housing 36. The outer walls 44 extend between a mating end 46 and a cable end 48 of the housing 36. In an exemplary embodiment, the outer walls 44 include a top wall 50, a bottom wall 52 and opposed side walls 54, 56. The latch 26 extends from the top wall 50. Other configurations are possible in alternative embodiments. In one embodiment, the housing 36 is fabricated from a non-conductive material, such as plastic, and is molded into form. Optionally, the latch 26 may be integrally formed with the housing 36, however the latch 26 may be separately provided in alternative embodiments.

The contacts 24 are provided within the cavity 42 for interfacing with the mating contacts 22 (shown in FIG. 1) of the mating connector 12 (shown in FIG. 1). The contacts 24 may be terminated to individual wires (not shown) of the cable 34 proximate the cable end 48 of the housing 36.

The latch 26 extends between a fixed end 60 and a distal end 62. The latch 26 is cantilevered such that the distal end 62 is elevated from the top wall 50 of the housing 36. The latch 26 is movable between a latched position, such as the position shown in FIG. 2, and an unlatched position. In the unlatched position, the latch 26 is positioned relatively closer to the top wall 50 of the housing 36. For example, when the latch 26 is depressed downward, the latch 26 rotates about the fixed end 60 generally toward the top wall 50.

The latch 26 includes a latching surface 64 that is configured to engage a corresponding latching surface (not shown) of the mating connector 12 to securely couple the electrical connector 10 to the mating connector 12. For example, that latching surface 64 of the latch 26 engages the latching surface of the mating connector 10 when the latch 26 is in the latched position. Removal of the electrical connector 10 is restricted by the engagement of the latching surface 64 with the latching surface of the mating connector 12.

The latch 26 includes a window 66 proximate the distal end 62. In an exemplary embodiment, the window 66 is rectangular and is defined by a forward edge 68, a rearward edge 70 and side edges 72. Alternatively, the window 66 may have a different shape. Optionally, the edges 68-72 may extend generally perpendicularly from a top surface 74 of the latch 26. In an exemplary embodiment, the window 66 extends entirely through the latch 26 from the top surface 74 to a bottom surface 76. Alternatively, the window 66 extends only partially through the latch 26 from either the top surface 74 or the bottom surface 76.

Figure 3:
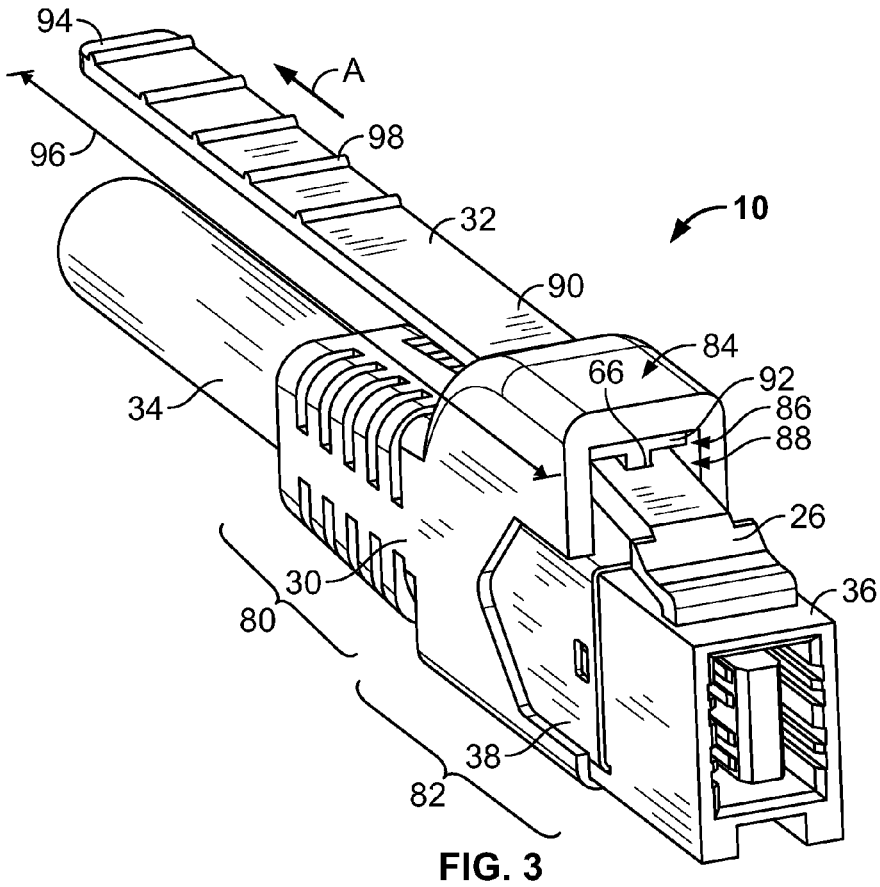
FIG. 3 is a front perspective view of the electrical connector with the boot and tether provided.

FIG. 3 is a front perspective view of the electrical connector 10 with the boot 30 and tether 32 provided. The boot 30 includes a strain relief portion 80 that surrounds, and is coupled to, the cable 34. The strain relief portion 80 is provided at a rear of the boot 30. The boot 30 also includes a connector portion 82 that surrounds at least a portion of the electrical connector 10. For example, the connector portion 82 may surround at least part of the ferrule 38 and/or at least part of the housing 36. The connector portion 82 is provided at a front of the boot 30. Optionally, the connector portion 82 may be securely coupled to the electrical connector 10, such as by a friction fit, a mechanical fastener, an adhesive, and the like.

In an exemplary embodiment, the connector portion 82 includes a hood portion 84. The hood portion 84 defines a cavity 86 that has an opening 88 providing access thereto. In the illustrated embodiment, the hood portion 84 is provided at the front of the boot 30 and is provided on top of the housing 36 and/or ferrule 38. The latch 26 extends at least partially into the cavity 86 defined by the hood portion 84. As such, the hood portion 84 protects the latch 26. Optionally, the boot 30, and particularly the hood portion 84, may be manufactured from a synthetic material, such as a plastic material or a rubber material. The hood portion 84 may be flexible to allow manual actuation of the latch 26 by pressing on the hood portion 84 in the vicinity of the latch 26.

The tether 32 is coupled to the latch 26 inside the hood portion 84. The tether 32 is configured to be pulled in a pulling direction, shown by arrow A in FIG. 3, to actuate the latch 26. The tether 32 is movable between a released position and an actuated position. When sufficient force is applied to the tether 32 in the pulling direction, the tether 32 is moved from the released position to the actuated position. When the tether 32 is released, the tether 32 is movable back to the released position in a direction generally opposite to the pulling direction. Optionally, the tether 32 may be automatically returned to the released position due to resiliency of the latch, such that the operator is not required to manually move or push the tether 32 back to the released position. In other embodiments, the tether 32 may be arranged such that the operator is required to move the tether 32 back to the released position.

The tether 32 includes a body 90 extending between a mating end 92 and a pulling end 94. In an exemplary embodiment, the tether 32 is fabricated from a synthetic material, such as a plastic material or a rubber material. The tether 32 may be flexible such that the tether 32 may be manipulated by a user during operation. The mating end 92 engages the latch 26 and, as described in further detail below, actuates the latch 26 during operation. The tether 32 extends outward from a rear of the hood portion 84 to the pulling end 94. The pulling end 94 is positioned a distance 96 from the mating end 92 and the associated latch 26. The pulling end 94 is accessible to a user to grasp and pull generally in the pulling direction, which is generally away from the mating interface of the electrical connector 10. In an exemplary embodiment, a plurality of ribs 98 are provided at the pulling end 94 to provide additional grip when the user is pulling the tether 32.

Assembly of the electrical connector 10, and more particularly, positioning of the tether 32 within the cavity 86, is accomplished in an exemplary embodiment, by loading the tether 32 through the opening 88 in the front of the hood portion 84. For example, the pulling end 94 of the tether 32 is loaded into the cavity 86 through the hood portion 84 until the mating end 92 of the tether 32 engages the latch 26. In an exemplary embodiment, a portion of the tether 32 is received in the window 66. The tether 32 may be mounted to the electrical connector 10 as a final assembly stage. In an exemplary embodiment, the tether 32 may be mounted to the electrical connector 10 in the field by a technician immediately prior to coupling the electrical connector 10 with the mating connector 12. As such, the tether 32 may be an optional feature and the electrical connector 10 may be coupled to the mating connector 12, and un-coupled from the mating connector 12, without the tether 32. Additionally, the tether 32 is mated with the latch 26 in a simple fashion and without the need for additionally interconnecting components that may be lost, damaged or difficult to install.

Figure 4:
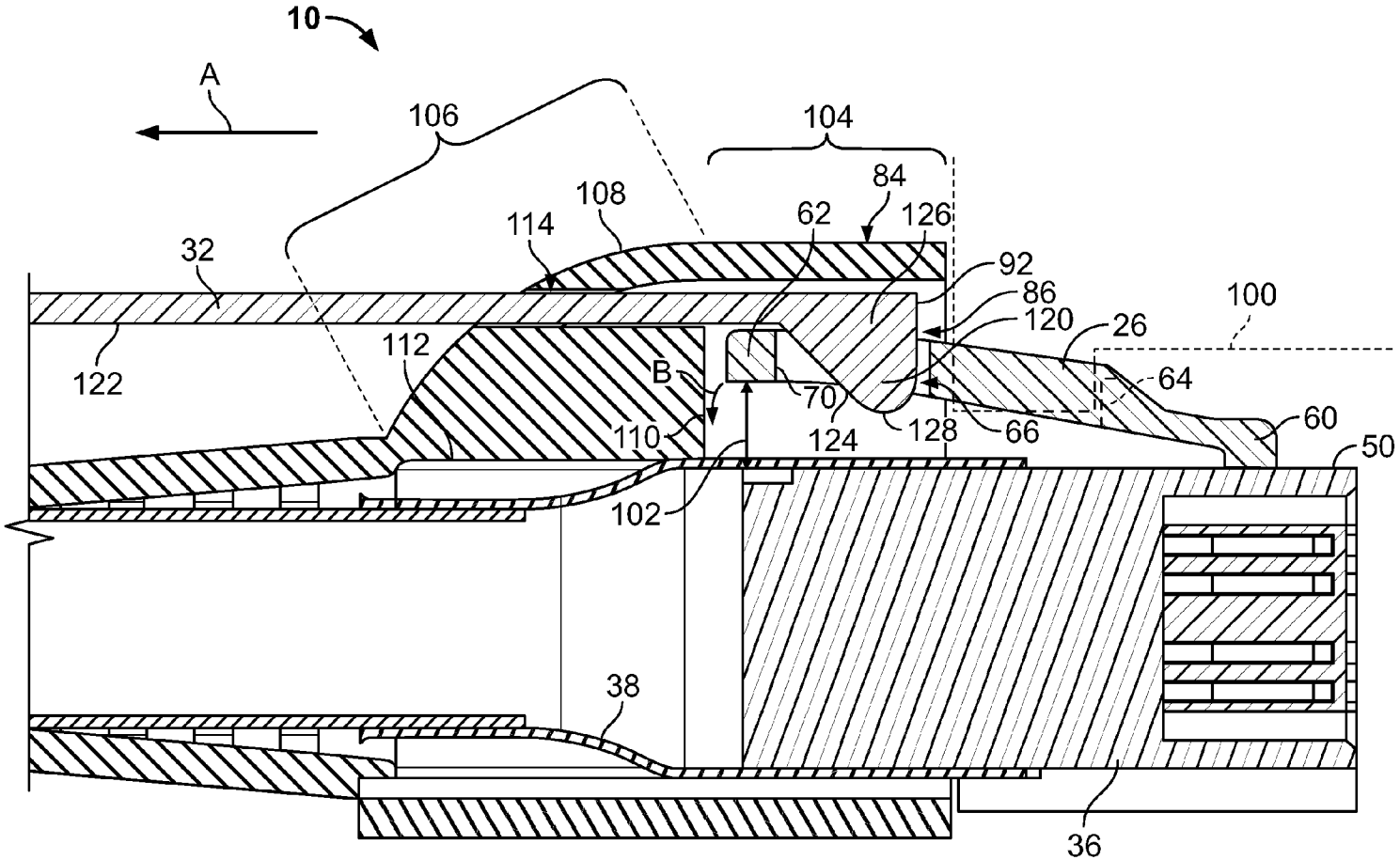
FIG. 4 is a cross sectional view of the electrical connector shown in FIG. 1 with a latch of the electrical connector in a latched position.

FIG. 4 is a cross sectional view of the electrical connector 10 with the latch 26 of the electrical connector 10 in a latched position and the tether 32 in a released position. In the latched position, the latching surface 64 engages a corresponding latching surface 100, which is shown in phantom in FIG. 4, of the mating connector (shown in FIG. 1). In the latched position, the distal end 62 of the latch 26 is elevated from the top wall 50 by a distance 102.

The hood portion 84 extends from the top of the housing 36 and the ferrule 38. The hood portion 84 is defined by a forward section 104 and a rear section 106. The forward section 104 defines the cavity 86 and extends generally parallel to the top of the housing 36 and the ferrule 38. The rear section 106 has a generally curved outer surface 108. Optionally, the rear section 106 may extend from the outer surface 108 to a front surface 110 and a bottom surface 112. The front surface 110 defines a back of the cavity 86. The bottom surface 112 may engage or rest upon the top of the ferrule 38. A channel or slot 114 is formed through the rear section 106 between the outer surface 108 and the cavity 86. The slot 114 is sized to receive the tether 32, which extends from the cavity 86, through the slot 114 and rearward from the rear section 106.

The tether 32 includes an embossment 120 extending generally perpendicularly from a bottom 122 of the tether 32. The embossment 120 is provided proximate the mating end 92. Optionally, the embossment 120 is provided at the mating end 92. The embossment 120 includes a ramp surface 124 that extends from a base 126 to a tip 128. The ramp surface 124 is generally rearward facing. The embossment 120 is received within the window 66 of the latch 26. The ramp surface 124 is generally facing, and may engage the rearward edge 70 of the window 66. In operation, when the tether 32 is pulled in the pulling direction, shown by arrow A, the ramp surface 124 engages the rearward edge 70 and the rearward edge 70 rides down the ramp surface 124 generally from the base 126 toward the tip 128. As the tether 32 is pulled in the pulling direction, the latch 26 is moved toward the unlatched position (shown in FIG. 5). For example, the distal end 62 is rotated about the fixed end 60 generally toward the housing 36 and the ferrule 38, such as in an unlatching direction shown by arrow B in FIG. 4.

Figure 5:
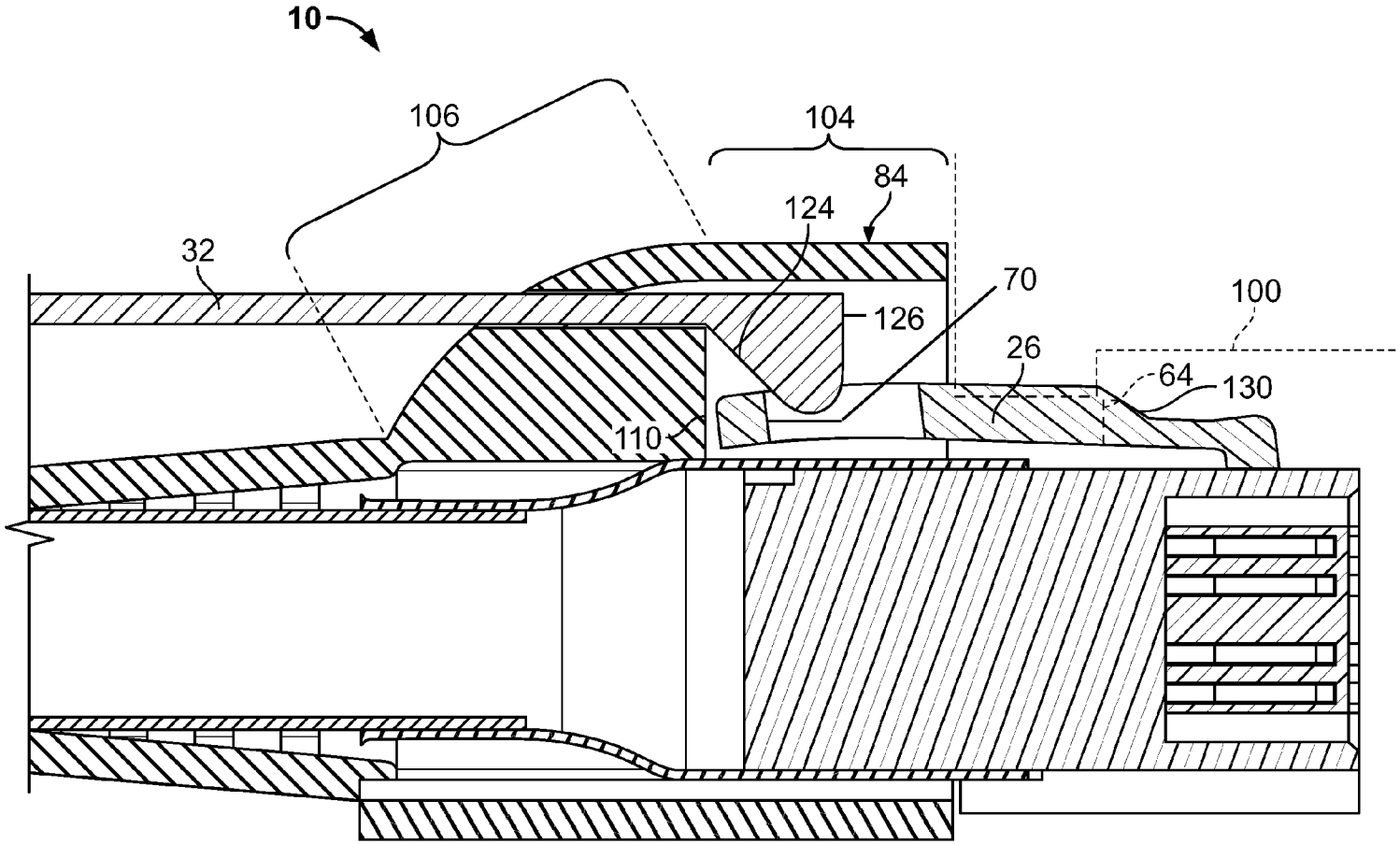
FIG. 5 is a cross sectional view of the electrical connector with the latch in an unlatched position.

FIG. 5 is a cross sectional view of the electrical connector 10 with the latch 26 in an unlatched position and the tether 32 in an actuated position. In the unlatched position, the latching surface 64 is positioned below the latching surface 100 of the mating connector 12 (shown in FIG. 1). As such, the latching surface 100 no longer engages or blocks the latching surface 64. The electrical connector 10 may be disengaged and removed from the mating connector 12.

As described above, in an exemplary embodiment, the tether 32 is utilized to transfer the latch 26 from the latched position (shown in FIG. 4) to the unlatched position. However, the latch 26 may be moved to the unlatched position independent of actuation by the tether 32. For example, pressing downward on the forward section 104 of the hood portion 84 may deflect the latch 26 without moving the tether 32 to the actuated position. Additionally, the latch 26 includes a ramp 130 forward of the latching surface 64. During mating of the electrical connector 10 with the mating connector 12, the ramp 130 engages the mating connector 12 and deflects the latch 26 to the unlatched position without the need to pull the tether 32 to the actuated position.

In operation, when the tether 32 is pulled to the actuated position, the ramp surface 124 engages the latch 26 and forces the latch 26 downward to the unlatched position. In an exemplary embodiment, the front surface 110 of the rear section 106 defines a shoulder that acts as a travel limit for the tether 32. For example, when the tether 32 is pulled to the actuated position, a portion of the ramp surface 124 engages the front surface 110. Further movement of the tether 32 in the pulling direction is restricted by the front surface 110.

In operation, in an exemplary embodiment, when the tether 32 is released, the latch 26 has adequate resiliency and/or flexibility to return to the latched position. For example, the material characteristics and/or the thickness of the latch 26 may force the latch 26 to tend to return to the normal or latched position. As the latch 26 returns to the latched position, the rearward edge 70 engages the ramp surface 124 and rides up the ramp surface 124 generally toward the base 126 forcing the tether 32 to return to the released position. In this manner, the tether 32 is automatically returned to the released position without requiring the operator to move or push the tether 32 back to the released position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a housing having a plurality of contacts defining a mating interface for a mating connector;

a latch extending from the housing, the latch having a window, the latch being configured to securely couple the housing to the mating connector, the latch being depressible to an unlatched position;

a tether mated with the latch, the tether being movable between a released position and an actuated position, the tether depressing the latch to the unlatched position when the tether is moved to the actuated position, wherein the tether includes an embossment extending into the window and engaging an edge of the latch defining the window to transfer the latch to the unlatched position.

2. The electrical connector of claim 1, wherein the latch includes a distal end and a fixed end, the latch includes a window proximate the distal end, the tether being received in the window.

3. The electrical connector of claim 1, wherein the embossment engages the latch as the tether is moved to the actuated position.

4. The electrical connector of claim 1, wherein the embossment includes a ramp surface extending from a base to a tip, the latch riding along the ramp surface toward the tip as the tether moves to the actuated position.

5. The electrical connector of claim 1, wherein the embossment includes a ramp surface extending from a base to a tip, the latch riding along the ramp surface toward the base as the tether moves to the released position.

6. The electrical connector of claim 1, wherein the tether includes a ramp surface, the latch having adequate resiliency to force the tether to the released position by engaging the ramp surface as the latch returns to the latched position.

7. The electrical connector of claim 1, further comprising a boot surrounding a portion of the housing, the boot includes a hood portion, the tether engaging the latch inside the hood portion.

8. The electrical connector of claim 7, wherein the tether extends through a slot in the boot and the tether is movable with respect to the boot.

9. The electrical connector of claim 7, wherein the boot includes a front generally facing the mating connector and a rear, the tether being loaded into the hood portion through the front and extending from the rear of the hood portion.

10. An electrical connector comprising:

a housing extending between a mating end a cable end being mated to an end of a cable, the housing having a plurality of contacts arranged at the mating end;

a boot surrounding the housing and being securely coupled to the cable to provide cable strain relief, the boot having a hood portion;

a latch having a window, the latch extending from the housing proximate the mating end into the hood portion of the boot, the latch being movable between a latched position and an unlatched position, the latch being positioned relatively closer to the housing in the unlatched position;

a tether being at least partially received in the hood portion of the boot, the tether being received in the window to mate with the latch, the tether being movable between a released position and an actuated position, wherein the tether forces the latch to the unlatched position when the tether is moved to the actuated position.

11. The electrical connector of claim 10, wherein the tether includes an embossment extending therefrom, the embossment engaging the latch as the tether is moved to the actuated position.

12. The electrical connector of claim 10, wherein the latch has adequate resiliency to return to the latched position when the tether is released.

13. The electrical connector of claim 10, wherein the tether extends through a slot in the boot and the tether is movable with respect to the boot.

14. The electrical connector of claim 10, wherein the boot includes a surface defining a shoulder, the shoulder being a travel limit for the tether when the tether is moved to the actuated position.

15. An electrical connector comprising:

a housing having a plurality of contacts defining a mating interface for a mating connector;

a latch extending from the housing, the latch being configured to securely couple the housing to the mating connector, the latch being depressible to an unlatched position;

a tether having a generally planar body extending between a mating end and a pulling end, the mating end engaging the latch, the tether being slidably coupled to the housing such that the tether moves in a linear pulling direction generally defined as a direction extending from the mating end to the pulling end, the tether being movable between a released position and an actuated position when the tether is moved in the pulling direction, the tether having an embossment extending from a bottom of the body proximate to the mating end, the embossment includes a ramp surface extending outward from the bottom of the body to a tip remote from the bottom of the body, the ramp surface of the embossment engaging the latch when the tether is moved to the actuated position.

16. The electrical connector of claim 15, wherein a portion of the ramp surface proximate to the base engages the latch when the tether is in the released position and a portion of the ramp surface proximate to the tip engages the latch when the tether is in the advanced position.

17. The electrical connector of claim 15, wherein the latch includes a window defined by an edge, the embossment being received in the window, the ramp surface engages the edge defining the window when the tether is moved in the pulling direction.

18. The electrical connector of claim 15, wherein the embossment includes a second surface different from the ramp surface that extends between the tip and the body of the tether.

19. The electrical connector of claim 15, wherein the housing extends along a connector axis between a mating end and a cable end, the tether being moved in the pulling direction generally parallel to the connector axis away from the mating end.

20. The electrical connector of claim 15, wherein the body of the tether extends along the latch such that the latch is positioned between the body and the housing, the embossment extends outward from the body in the direction of the housing such that the embossment engages the latch.

21. The electrical connector of claim 15, wherein the bottom of the body is generally planar, the embossment being a triangular structure extending outward from the bottom.

22. The electrical connector of claim 15, further comprising a boot surrounding the housing, the boot having a hood portion receiving the latch and the tether, the tether extending through a slot in the boot from the hood portion, the tether being movable with respect to the boot in a linear sliding motion.

* * * * *